United States Patent [19]

Santo

[11] 3,947,219

[45] Mar. 30, 1976

[54] BURNER CONTROL WITH INTERRUPTED IGNITION

[75] Inventor: Eugenio Espiritu Santo, Rockford, Ill.

[73] Assignee: Sundstrand Corporation, Rockford, Ill.

[22] Filed: Feb. 24, 1975

[21] Appl. No.: 552,516

[52] U.S. Cl. ..... 431/79; 340/228.2

[51] Int. Cl.[2] ..... F23N 5/08

[58] Field of Search ..... 431/71, 79, 78; 340/228.2

[56] References Cited

UNITED STATES PATENTS

| | | | |
|---|---|---|---|
| 3,425,780 | 2/1969 | Potts | 431/71 X |
| 3,584,988 | 6/1971 | Hirsbrunner et al. | 431/71 X |
| 3,770,365 | 11/1973 | Lenski | 431/79 |

*Primary Examiner*—Edward G. Favors
*Attorney, Agent, or Firm*—Ted E. Killingsworth; Michael B. McMurry

[57] ABSTRACT

An interrupted ignition system for a burner control circuit having a primary side which has as its primary function the application of a line voltage to a burner motor and a fuel igniter and a secondary side, which is responsive to a thermostat, and includes a light sensitive element for detecting a flame at the burner plus a current responsive element which in combination with a circuit breaking switch in the primary functions as a circuit breaker for disconnecting the igniter and motor from the line voltage under certain conditions. The igniter is controlled by a triac switch in the primary side which in turn is responsive to an optical coupler connected to the secondary side of the burner control circuit. When the thermostat contacts are closed, thereby indicating a call for heat, the optical coupler will cause the triac to switch on resulting in current flow through the igniter. With the detection of a flame by the flame cell, the optical coupler will be shut off resulting in the switching off of the triac and the discontinuation of current through the igniter, thus permitting a reduction in the overall electrical power consumption of the system. In the event the flame should be lost, the optical coupler will again switch on the igniter until either a flame is detected or the circuit breaker opens disconnecting the primary side is disconnected from the line voltage.

9 Claims, 1 Drawing Figure

BURNER CONTROL WITH INTERRUPTED IGNITION

BACKGROUND OF THE INVENTION

The invention relates to the field of oil burner control and ignition systems and more particularly to an interrupted ignition system.

In prior art burner control systems, specifically represented by: Lenski U.S. Pat. No. 3,770,365; the application of Lenski entitled "Burner Control" Ser. No. 362,387 filed on May 21, 1973; the application of MacAskill entitled "Burner Control System With Primary Safety Switch"; and the application of MacAskill entitled "Burner Control System with Secondary Safety Switch", which are all assigned to the assignee of this application, an igniter is activated i.e. generates electrical sparks in order to ignite fuel oil, as long as power is being applied to a burner motor, that is used to supply the fuel.

Generally, once ignition has been achieved in a burner system, the fuel oil will continue to burn without the continued application of sparks from the igniter. With the increasing emphasis in reducing wasteful uses of power of all types, it has become apparent that the continued operation of the igniter after the fuel oil has been ignited provides a very significant use of electrical power that is by no means necessary. In addition, the sparks generated by the igniter in a burner control system have a tendency to produce other undesired effects such as generating electromagnetic radiation and electrical noise that can often interfere with the operation of various types of electronic devices including radios, televisions, controls for appliances and sensitive electronic instruments.

SUMMARY OF THE INVENTION

It is, therefore, an object of the invention to provide a burner control system wherein the igniter is activated only during the absence of flame.

It is another object of the invention to provide a burner control system having a primary and a secondary side wherein the operation of the igniter is controlled by a thermostat and a flame detecting cell in the secondary of the circuit.

It is a further object of the invention to provide a burner control system with interrupted ignition wherein the igniter is controlled by a triac type device in the primary of the burner control system and the triac is in turn controlled by an optical coupler which responds to a thermostat and a flame detecting cell in the secondary side of the burner control circuit.

It is an additional object of the invention to provide a burner control system with interrupted ignition having a fail safe device that automatically disconnects the burner motor and igniter from the line voltage in the event that flame is not detected within a predetermined time or when flame has been lost and not re-established within a predetermined time or when the switching device that controls the application of the line voltage to the motor and igniter shorts out.

The burner control circuit is comprised of two major portions; a primary circuit connected to a line voltage which has as its basic function a application of a line voltage to the burner motor and an igniter, and a secondary circuit that is responsive to both a thermostat and a light sensitive element for detecting a flame in the burner. The primary circuit includes a triac switching device, responsive to signals from the secondary via a first optical coupler, for connecting the motor and igniter to line voltage. In addition, the primary circuit contains a circuit breaking switch that is responsive to a current sensitive element contained in the secondary circuit, for disconnecting the primary circuit from the line voltage a predetermined time after current has begun to flow through the current sensitive element. The primary also includes a light source for a second optical coupler. The igniter itself is further controlled by a second triac switch connected between the line voltage and the triac which controls the application of the line voltage to the motor and the igniter. A third optical coupler, with its light sensitive, resistive element connected to the gate of the second triac, serves to switch on the igniter in response to signals from the secondary circuit during a portion of the time the burner motor has been connected to the line voltage by the first triac.

The secondary circuit, in response to a signal from the thermostat representing a call for heat, turns on the light generating sources of the first and third optical couplers thereby having the effect of connecting the burner motor and igniter to the line voltage. The closing of the thermostat contact also closes a second switch, for example, an SCR, that permits current to flow through the current sensitive element until the flame detecting cell senses a flame at the burner thus causing the second switch to turn off and preventing the circuit breaker from opening and disconnecting the line voltage. However, if the flame is not detected within the predetermined time, the circuit breaker will disconnect the motor and igniter from the line voltage. Detection of a flame by the flame detection cell also serves to discontinue current flow through the third optical coupler resulting in the turning off of the igniter.

During normal operation, when the thermostat contacts open as a result of a termination of a call for heat, the first optical coupler will turn off the triac thus disconnecting the motor and igniter from the line voltage. In the event the flame should go out during a call for heat, the flame cell will cause current to again flow through the third optical coupler thus turning on the igniter and also cause the SCR to allow current to pass through the heating element of the circuit breaker. If a flame is not reestablished within the time it takes the circuit breaker to time out, the circuit breaker switch in the primary will disconnect the motor from the line voltage.

A fail safe capability is provided by the second optical coupler, which is responsive to the application of the line voltage across the motor along with having a light sensitive resistance in the secondary which cooperates with the flame detecting cell to turn on the SCR. In the event the triac which connects the motor to the line voltage should become shorted in a closed condition, thus preventing the motor from being shut off when there is no longer a call for heat, the combination of the thermostat opening with the reduced resistance in the light sensitive element in the second optical coupler will cause the SCR to close thereby permitting current to flow through the current responsive element of the circuit breaker. This will have the net effect of disconnecting the line voltage from the motor and igniter when the thermostat is open and the first triac has shorted.

DETAILED DESCRIPTION OF THE INVENTION

Figure 1:
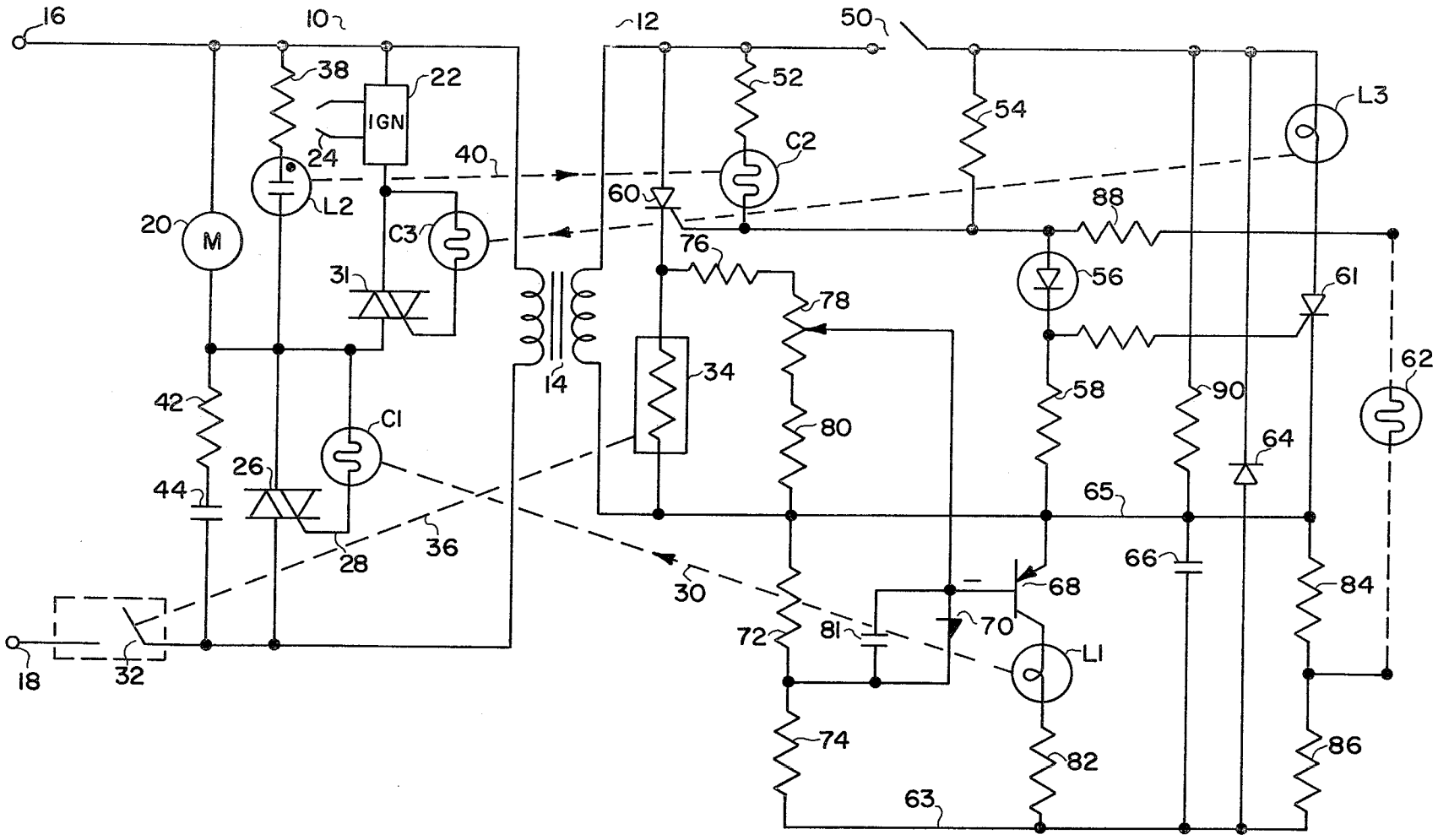
FIG. 1 is a schematic diagram of the burner control circuit.

The preferred embodiment of the invention is illustrated in FIG. 1 and is composed of a burner control circuit having a primary circuit 10 and a secondary circuit 12. The primary circuit 10 is operatively coupled to the secondary circuit 12 by means of a transformer 14. The primary circuit 10 is connected across a line voltage, typically 115–120 volts AC, by means of terminals 16 and 18. Associated with the primary circuit are a burner motor 20 and an igniter 22. The function of the motor 20 is to atomize the fuel oil and force it through or by the spark gap 24 of the igniter 22, thus causing the ignition of the fuel oil. Controlling the application of the line voltage across the motor 20 and igniter 22 is a switch 26 which, in the preferred embodiment, is a triac type device. The triac 26 responds to a reduced electrical resistance in a light sensitive element C1 that is connected by line 28 to the gate of the triac 26. Light sensitive element C1 forms a portion of an optical coupler L1-C1 having its light source L1 located in the secondary circuit 12 and where the operative relationship is indicated by the dashed line 30. When a light is applied to the light sensitive element C1 from light source L1 of the optical coupler, electrical resistance of C1 is substantially reduced, thus allowing a voltage to be applied to the gate of triac 26. This will serve to switch on triac 26 resulting in the line voltage being applied across both the motor 20 and the igniter 22. In the preferred embodiment of the invention, triac 26 is controlled by the optical coupler L1-C1 but it is apparent that this essentially relay type function could be accomplished by a wide variety of relay elements including an electromechanical relay.

In addition to the triac 26, the primary 10 contains a circuit breaking switch 32 which in turn is controlled by a heat or current sensitive element 34 in the secondary 12. This control relationship is indicated by the dashed line 36. The combination of the current sensitive element 34 and the switch 32 is equivalent to, and can be implemented by a wide variety of commercially available circuit breakers. As is typical of current sensitive circuit breakers, when current flows through the current or heat sensitive element 34, it will gradually heat the element until it reaches a predetermined temperature whereupon it will cause switch 32 to open. A second optical coupler, L2-C2, forms another portion of the burner control circuit and performs essentially a relay type function. The light generating element L2 is connected in parallel with the motor 20 and igniter 22 as well as being in series with the triac 26. In the preferred embodiment of the invention the light source L2 is a neon lamp that generates light whenever triac 26 is turned on and the line voltage is applied to the primary 10. Light sensitive element C2 forms a portion of the secondary 12 and its operative relationship with L2 is indicated by the dashed line 40. The primary 10 also includes the resistor 42 and the capacitor 44 which are connected in parallel with the triac 26 forming a "snubber circuit" in order to suppress the stress in the triac 26 caused by inductive loads.

Application of the line voltage to the igniter in the preferred embodiment is further controlled by means of a second triac 31 and the light sensitive resistance C3 of an optical coupler L3-C3. When the first triac 26 is turned on, the line voltage is applied to both the second triac 31 and light sensitive resistance C3. As light is generated by L3, the resistance in C3 is lowered thus permitting the line voltage to be applied to the gate of the triac 31 resulting in the switching on of triac 31. This relay function can, of course, be accomplished by a wide variety of mechanical or electromechanical relay systems.

The secondary of the transformer 14 provides the secondary side 12 of the circuit with, in the preferred embodiment, approximately 12 volts AC. Responding to a call for heat, the contacts of the thermostat 50 close, thereby serving to energize the secondary circuit 12 of the circuit. Prior to the closing of the thermostat contacts 50, current will not be able to flow through a resistor 52 and light sensitive element C2 due to the fact that resistance of C2 will be very high. At this point, it will be remembered, that triac 26 will be in a non-current conducting state and light source L2 will be off.

Upon the closing of the thermostat contacts 50, current will flow through resistor 54, through light emitting diode 56 and resistor 58. This current flow will serve to apply a voltage to the gate of an electronic switch 60 which, in the preferred embodiment, is a silicon controlled rectifier or SCR. This voltage applied to the gate of SCR 60 will be sufficiently positive to turn it on thus allowing current to flow through current sensitive element 34 of the circuit breaker. In addition, the voltage drop across LED 56 and the resistor 58 applied to the gate of SCR 60, will be sufficient to turn on SCR 61 and permit current to flow through L3.

Also included in the secondary side is a flame sensitive element 62, which is preferably a light sensitive cadmium photo resistive cell located adjacent to the burner (not shown) so that the cell 62 is responsive to the presence or absence of a flame at the burner. Flame cell 62 is shown with dashed lines because it is normally not included in the same physical package as the rest of the circuit. Normally flame cell 62 will have a very high resistance until a flame is present in the burner whereupon its electrical resistance will drop to a very low value. When this occurs, an alternate current path is opened so that the positive voltage previously applied to the gate of the SCR 60 will be, in effect, removed, thus turning off SCR 60. By the same token, SCR 61 will be turned off when the flame cell 61 detects a flame, resulting in the igniter 22 being shut off and thereby conserving a significant amount of electrical power.

The secondary 12 further includes a diode 64 and a capacitor 66 that cooperate, when the thermostat contacts 50 are closed, to establish a negative DC potential across lines 63 and 65. The cathode of an asymmetrical switching diode 70 is connected to a voltage divider composed of resistors 72 and 74. During normal operation, just after the thermostat contacts are closed but before a flame is detected by the flame cell 62, SCR 60 will permit current to flow through current sensitive element 34 and through resistors 76, 78, and 80. A portion of the positive voltage developed across the current sensitive element 34 is applied to the asymmetrical switching diode 70 through resistor 76 and the adjustable resistance 78. This positive voltage will cause diode 70 to break over and latch in a current conducting state thus serving to turn on transistor 68. The capacitor 81 prevents the asymmetrical switch 70 from being triggered by electrical noise or transient signals in the circuit. When transistor 68 is in a current conducting state, current flows from transistor 68 to resistor 82 and through the light generating element L1 resulting in the application of the line voltage to the motor 20 and the igniter 22. If for some reason a flame is not present or detected by the flame cell 62 within a predetermined amount of time, the current sensitive element 34, as previously explained, causes the circuit breaking switch 32 to open, thus disconnecting the motor 20 and igniter 22 from the line voltage.

An additional safety feature is provided to compensate for a short in the flame detecting cadmium cell 62. Resistors 84 and 86 form a voltage divider that is effective to apply the negative voltage from line 63 through the shorted flame detector cell 62 to the gate of the SCR 60 thereby preventing the activation of the system. The diode 64 and capacitor 66 produce approximately a negative 12 volts at line 63. In addition, a resistor 88 is placed in circuit between the flame detecting cell 62 and SCR 60 in order to prevent excessive current from being applied to the gate of the SCR 60 in the event of a short across the flame detecting cell 62. Another resistor 90 is placed in the circuit between line 65 and the thermostat 50 in order to provide for sufficient current flow through the thermostat ensure proper operation of the thermostat's anticipator circuitry.

Another very important feature of the burner control circuit of FIG. 1 is the fail safe capability that is implemented with the aid of the optical coupler L2-C2. This fail safe capability is most useful in the event that triac 26 shorts in a current conducting state thereby preventing the motor 20 or igniter 22 from turning off when the thermostat contacts 50 are opened. In the event this condition should occur, there will be enough current flowing through the neon lamp L2 to have the effect of lowering the resistance in the light sensitive element C2. With the opening of the thermostat contact 50 and the low resistance in C2, a sufficiently positive voltage will be applied to the gate of SCR 60 to turn it on. This will result in the current sensitive element 34 eventually timing out and opening the circuit breaking switch 32 thus preventing damage to the burner system as a whole. Another particularly useful aspect of this arrangement concerns the fact that it is possible to utilize the burner control system even when the triac 26 is in a permanently shorted condition. For example, if parts or properly qualified service personnel are not available, it is possible for the owner to utilize his burner control system in a manual fashion simply by resetting the circuit breaker whenever the temperature drops below the desired level. Resetting the circuit breaker when the thermostat contacts 50 are closed will cause the burner and motor to operate in a normal manner until the thermostat contacts open indicating that the desired temperature has been reached.

I claim:

1. A burner control system having a burner motor, an igniter, a flame detecting means, and a thermostat, with an interrupted ignition capability comprising:

a primary circuit including a first triac for connecting the burner motor and igniter to a line voltage and a second triac for disconnecting the igniter from the line voltage;

a secondary circuit responsive to the thermostat and the flame detecting means; and an optical coupler having its light generating source operatively connected to said secondary circuit and its light sensitive resistance connected to the gate of said second triac, effective to interrupt ignition in the presence of a burner flame.

2. The system of claim 1 wherein said second circuit additionally includes: an electronic switch operatively connected between said light source and a voltage source in said secondary circuit; and a circuit operatively connected to the gate of said electronic switch and responsive to the thermostat and said flame detecting means for activating said light source in response to a call for heat and the absence of a flame at the burner.

3. The system of claim 2 wherein said electronic switch is a silicon controlled rectifier.

4. The system of claim 1 additionally including:

circuit breaker means for disconnecting the burner motor and igniter from the line voltage wherein said circuit breaker means includes a current sensitive element in said secondary circuit; and a fail safe means for activating said circuit breaker means in the event said first switch should fail.

5. The system of claim 4 wherein:

said circuit breaker means includes a circuit breaker switch in said primary circuit responsive to said current sensitive element;

a second optical coupler with its light sensitive resistive element operatively connected to the gate of said first triac, and its light source operatively connected to said secondary circuit and responsive to said thermostat and said flame detecting means; and said fail safe means includes a third optical coupler having its light generating source responsive to the application of the line voltage across the motor and an electronic switch in said secondary circuit, responsive to said third optical coupler, effective to permit current to flow through said current sensitive element of said circuit breaker.

6. In a burner control system having: a primary circuit including a switch for connecting a burner motor and an igniter to a source of line voltage and a secondary circuit having a thermostat and a flame detecting means, a circuit for disconnecting the igniter comprising:

switch means, in said primary circuit, for disconnecting the igniter from the line voltage;

an optical coupler operatively connected to said switch means and to a voltage source in the secondary circuit;

a second switch means, in the secondary circuit and responsive to the thermostat and the flame detecting means, for admitting current from said voltage source to the light generating element of said optical coupler in response to a call for heat and an absence of flame.

7. The system of claim 6 wherein said switch means is a triac having its gate operatively connected to the light sensitive resistance of said optical coupler.

8. The system of claim 7 wherein said second switch means is a silicon controlled rectifier having its gate connected in circuit with the thermostat and the flame detecting means and effective to turn on said silicon controlled rectifier when the thermostat contacts are closed and a flame is not detected at the burner thereby permitting current to flow through the light source of said optical coupler switching on said triac in order to activate the igniter.

9. A burner control circuit comprising:

a primary circuit, operatively connected to a line voltage, including: a burner motor; an igniter; a first triac for connecting said motor and said igniter to said line voltage; a second triac for disconnecting said igniter from said line voltage; and a circuit breaker switch for disconnecting said primary circuit from said line voltage;

a secondary circuit, operatively connected to a thermostat, including: a current sensitive element operatively connected to said circuit breaking switch; a first silicon controlled rectifier operatively connected to said current sensitive element; a flame detecting cell operatively connected to the gate of said first silicon controlled rectifier; a source of direct current connected to said flame detecting cell; and a second silicon controlled rectifier operatively connected to said source of direct current and having its gate operatively connected to said flame detecting cell;

a transformer operatively connected to said primary and said secondary circuits;

a first optical coupler operatively connected between said first triac and said secondary circuit;

a second optical coupler operatively connected between said primary circuit and the gate of said first silicon controlled rectifier; and a third optical coupler operatively connected between said second silicon controlled rectifier and said second triac.

* * * * *